US011253032B2

(12) United States Patent
Gabutti et al.

(10) Patent No.: US 11,253,032 B2
(45) Date of Patent: Feb. 22, 2022

(54) SLIDE FASTENER TAPE

(71) Applicant: YKK Corporation, Tokyo (JP)

(72) Inventors: Pier Marco Gabutti, Vercelli (IT); Giovanni La Rocca, Vercelli (IT); Yusuke Meiwa, Vercelli (IT)

(73) Assignee: YKK Corporation

( * ) Notice: Subject to any disclaimer, the term of this patent is extended or adjusted under 35 U.S.C. 154(b) by 0 days.

(21) Appl. No.: 16/721,180

(22) Filed: Dec. 19, 2019

(65) Prior Publication Data

US 2020/0196718 A1 Jun. 25, 2020

(30) Foreign Application Priority Data

Dec. 21, 2018 (IT) ..... 102018000020731

(51) Int. Cl.

| | |
|---|---|
| ***A44B 19/34*** | (2006.01) |
| ***D03D 1/00*** | (2006.01) |
| ***D03D 11/00*** | (2006.01) |
| ***D03D 15/00*** | (2021.01) |
| ***D03D 15/43*** | (2021.01) |

(52) U.S. Cl.

CPC ..... *A44B 19/346* (2013.01); *D03D 1/00* (2013.01); *D03D 11/00* (2013.01); *D03D 15/43* (2021.01); *D10B 2501/0631* (2013.01)

(58) Field of Classification Search

CPC ..... D03D 15/43; D03D 1/00; D03D 11/00; D03D 11/02; D03D 15/00; A44B 19/346; D10B 2501/0631

See application file for complete search history.

(56) References Cited

U.S. PATENT DOCUMENTS

| | | | | |
|---|---|---|---|---|
| 2,201,772 A * | 5/1940 | Hendley | ..... | D03D 1/00 139/383 R |
| 4,196,763 A * | 4/1980 | Imamura | ..... | B60C 9/0042 139/426 R |
| 6,401,763 B2 * | 6/2002 | Shimono | ..... | A44B 19/54 139/384 B |

(Continued)

FOREIGN PATENT DOCUMENTS

| | | |
|---|---|---|
| EP | 1886593 | 2/2008 |
| EP | 2181616 | 5/2010 |

(Continued)

OTHER PUBLICATIONS

YKK Corporation; Office Action for Italy patent application No. 102018000020731, filed Dec. 21, 2018, dated Sep. 27, 2019, 9 pgs.

(Continued)

*Primary Examiner* — Robert Sandy
*Assistant Examiner* — Louis A Mercado
(74) *Attorney, Agent, or Firm* — Taylor English Duma LLP

(57) ABSTRACT

A slide fastener tape is provided. The slide fastener tape extends in a longitudinal direction. The slide fastener includes a weave structure formed with warp threads arranged in the longitudinal direction, and weft threads arranged along a transversal direction perpendicular to the longitudinal direction. The slide fastener tape includes a cord arranged along one side edge portion of the fastener tape. The weft threads are made from filament yarns and the warp threads comprise a plurality of threads made from spun yarn.

8 Claims, 6 Drawing Sheets

(56) References Cited

U.S. PATENT DOCUMENTS

| | | | | |
|---|---|---|---|---|
| 6,826,807 | B2 * | 12/2004 | Inoue | A44B 17/0064 24/306 |
| 7,836,563 | B2 * | 11/2010 | Horikawa | A44B 19/346 24/393 |
| 8,151,418 | B2 * | 4/2012 | Nakayama | A44B 19/12 24/392 |
| 9,596,909 | B2 * | 3/2017 | Miyazaki | A44B 19/24 |
| 2006/0016052 | A1 * | 1/2006 | Horikawa | A44B 19/346 24/393 |
| 2013/0177734 | A1 | 7/2013 | Hasegawa et al. | |

FOREIGN PATENT DOCUMENTS

| | | | | |
|---|---|---|---|---|
| EP | 2622982 | | 8/2013 | |
| EP | 2769638 | | 8/2014 | |
| GB | 758533 | A * | 10/1956 | A44B 19/346 |
| TW | 201212845 | | 4/2012 | |
| WO | 2015189918 | | 12/2015 | |
| WO | 2015189966 | | 12/2015 | |

OTHER PUBLICATIONS

YKK Corp; Office Action for French patent application No. FR1915346, filed Dec. 20, 2019, dated Nov. 19, 2021, 17 pgs.

* cited by examiner

SLIDE FASTENER TAPE

CROSS REFERENCE TO RELATED APPLICATIONS

This application is based on Italian Patent Application (No. 102018000020731) filed on Dec. 21, 2018, the contents of which are incorporated herein by way of reference.

BACKGROUND

The present invention relates to a slide fastener, and more particularly to a slide fastener tape.

As known, a slide fastener comprises a pair of tapes laid flat. The tapes each have inner facing edges where cords are formed and elements (or teeth) are attached to the cords and the inner edges of the tapes. When the edges are drawn closer to each other by the action of a slider on the respective elements, these elements are forced to interdigitate with each other. Tapes with elements attached in this manner are known as stringers. When two stringers are combined together, they are known as a chain. A slide fastener generally comprises a chain, at least one slider, a top stop and a bottom stop are attached to the chain. When a slide fastener is to be opened/closed, the user normally takes hold of a pull-tab linked to the slider and pulls the slider forward or backwards. This will close or open the slide fastener, depending on the direction of travel of the slider.

The present invention relates to an improvement in a slide fastener chain. There are various reasons why a slider may not run up and down the chain smoothly. This could be because of the shape of the slider, the manner in which the teeth interdigitate, so creating extra friction with the slider or the general stability of the teeth within the slider. To ensure a smooth movement of the slider, each element should keep an optimal position in relation to the other elements and the slider.

As known, sliders consist of an upper wing and a lower wing usually of the same size and positioned so that the upper wing covers the entirety of the lower wing, with a connecting post or diamond at the front and centre of each of the wings, holding them together. At the edges of the upper wing on the direction of travel of the slider pointing downwards and at the edges of the lower wing on the direction of travel of the slider pointing upwards are flanges also known as guide rails.

A fastener tape may be knit or woven, a fastener tape having a weave structure is formed with weft yarns and warp yarns. The warp yarns of the fastener tape are generally arranged along a longitudinal direction, parallel to the sliding direction of the slider, and the weft yarns are arranged along a transversal direction, perpendicular to the sliding direction of the slider.

In some cases, the flanges of the slider may rub against the tape in the vicinity of the fastener elements and, as a consequence of the friction, the tape may fray. In order to prevent this, EP 2769638 B1 teaches to thicken the tape with a double weave in a region of the tape near the slider.

WO 2015/189918 A1 discloses a fastener stringer having a fastener tape which is a weave of warp yarns woven with weft yarns and comprises a main tape section and an element-attaching section. Fastener elements are sewn on the element-attaching section by sewing yarn. The main tape section is configured from at least first warp yarns and weft yarns, and each of the first warp yarns and the weft yarns are spun yarns. The element-attaching section of the tape, i.e. the region where the teeth are attached to the cord and tape, is made of at least second warp yarns and weft yarns. The second warp yarns are filament yarns. There is room for improvement in the strength of the tape and therefore in the quality of the slide fastener.

The present disclosure relies on an inventive use of spun yarn and filament yarn. The difference between filament yarn and spun yarn for the purpose of this invention comes from the fact that spun yarns are the result of spinning together individual shorter fibres to make a yarn. Bringing fibres together by spinning tends to result in small fibres on the surface of the yarn coming loose and making a plurality of fibrous protrusions effectively randomly and possibly continuously on the surface. In some circumstances, magnified photography or other means might be necessary to see the protrusions.

This can to some extent be reduced by the twist obtained by twisting one or more yarns into a thread.

Filament yarn, on the other hand, is often made through a chemical process and involves the production of one long fibre removing the need for spinning.

Of course, for a variety of effects, one or more fibres can be spun together should it be required.

Thus, filament yarn tends to be stronger and harder, spun yarn may unravel whereas filament yarn, (unless more than one such yarn is spun together) cannot. This implies a weaker thread, but also a more indulgent feel in spun yarn.

SUMMARY

The present invention provides an improvement in the relationship between the cord and the yarns that make the tape. Particularly, the invention improves the attachment between the fastener elements and the cord and the tape.

According to an aspect, the invention provides a slide fastener tape, the tape extending in a longitudinal direction and having a weave structure formed with warp threads arranged in the longitudinal direction, and weft threads arranged along a transversal direction perpendicular to the longitudinal direction, the tape including a cord arranged along one side edge portion of the fastener tape.

The weft threads are made from filament yarns and the warp threads comprise a plurality of threads made from spun yarn.

According to an embodiment, the weft threads may be made only from filament yarns and the warp threads may be made only from spun yarn. Alternatively, the warp threads may comprise a mixture of spun yarns and filament yarns.

Embodiments may provide that the spun yarns contain only short fibres. Alternative embodiments may provide spun yarns having short fibres mixed with filament fibres. Optionally, the spun yarns may comprise at least one central filament fibre onto which shorter fibres are spun.

According to one or more embodiments, the weave structure may be provided with a side edge portion which encloses the cord and a main body portion other than the side edge portion, and the warp threads in the side edge portion may comprise a plurality of spun yarns.

According to another aspect, the invention provides a slide fastener stringer, comprising a slide fastener tape and a row of fastener elements arranged along one side edge portion of the fastener tape.

According to a further aspect, the invention provides a slide fastener, comprising left and right fastener stringers and a slider for engaging and disengaging the two rows of left and right fastener elements with and from each other. The left and right fastener stringers respectively comprise a left and a right fastener tape extending in a longitudinal direction. The left and right fastener tapes both have a weave structure formed with warp threads arranged in the longitudinal direction, and weft threads arranged along a transversal direction perpendicular to the longitudinal direction.

BRIEF DESCRIPTION OF DRAWINGS

By way of example, embodiments of a slide fastener and a slide fastener tape according to the present invention will now be described with reference to the accompanying drawings, in which.

DESCRIPTION OF EXEMPLIFIED EMBODIMENTS

Figure 1:
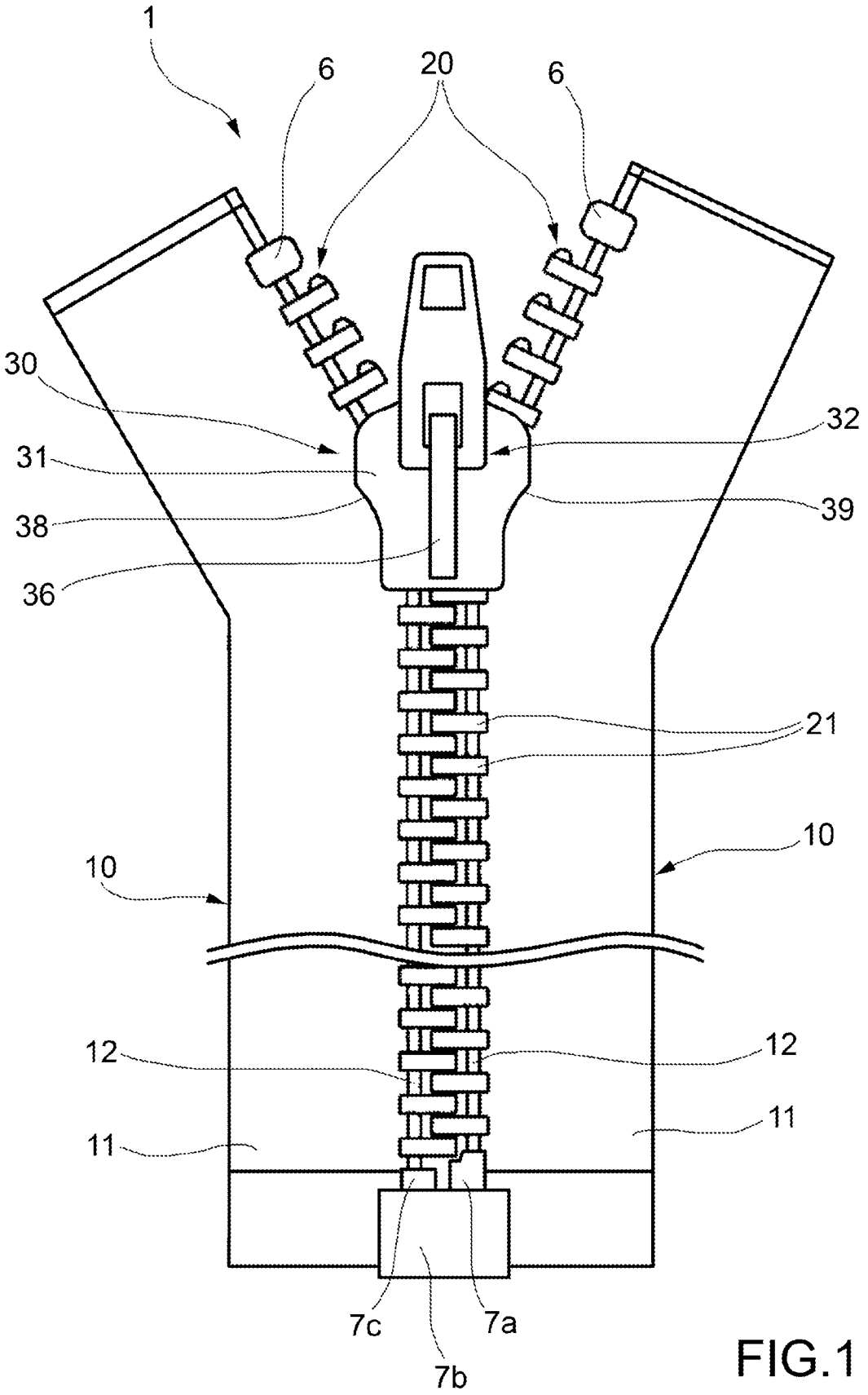
FIG. 1 is a schematic diagram showing a slide fastener according to an embodiment of the invention.

FIG. 1 is a schematic diagram showing a slide fastener according to an embodiment of the invention.

In the description described below, a forward and backward direction refers to a longitudinal direction of the fastener tape and is the same direction as a sliding direction of a slider. Particularly, a direction that the slider is slid in a way that the slide fastener is closed by engaging right and left fastener elements is defined as the forward, and a direction that the slider is slid in a way that the slide fastener is opened by disengaging right and left fastener elements is defined as the backward.

The right and left direction refers to a tape width direction of the fastener tape, which is perpendicular to the tape longitudinal direction. In addition, an upward and downward direction refers to a front and back direction of a fastener tape perpendicular to the tape surface of the fastener tape, and especially, a direction of the side on which a pull tab of the slider is arranged with respect to the fastener tape is defined as the upward and a direction of the opposite side thereof is defined as the downward.

A slide fastener 1 includes a pair of right and left fastener stringers 10, each having a ribbon or band-like fastener tape 11. The fastener tapes 11 each have inner side facing edges where cords 12 are incorporated. An element row 20 is attached to each tape inner side edge portion 11*a* and the relevant cord. Each element row 20 is formed by a plurality of fastener elements 21 which are attached to the cord and the tape inner side edge portion 11*a*. Preferably, the fastener elements are discretely attached (that is not continuously). The discrete fastener elements may be made of metal. The metal fastener elements may either be attached directly, cut from wire, or treated prior to attachment, for example by subjecting the elements to surface treatments to change the colour of the metal, or polishing it to make it brighter. Alternatively, the fastener elements 21 may be made of plastic, injection moulded to the cords and tapes.

A first stop 6 (also called a top stop) may be disposed on a forward end portion of each of the fastener stringers 10 and adjacent to the element row 20. A second stop (or bottom stop) may be disposed so as to extend over a backward end portion of a pair of fastener stringers 10 and adjacent to the element row 20. The bottom stop may comprise a box and pin arrangement, whereby a first one of the two stringers has a pin-shaped protrusion 7*a* extending along a first stringer away from the fastener elements 21. Such a protrusion is designed to go through one side of a Y-shaped channel provided by a slider 30, which is slidably arranged along the element rows 20. On the other, second stringer there is a similar pin portion 7*c* starting to extend along the second stringer, but attached to the pin portion 7*c* is a receptacle (or "box") 7*b*. The box 7*b* is provided for the pin-shaped protrusion 7*a* of the first stringer, into which that protrusion 7*a* is inserted and so holds the engaged chain in place once the slider has passed along it.

Figure 2:
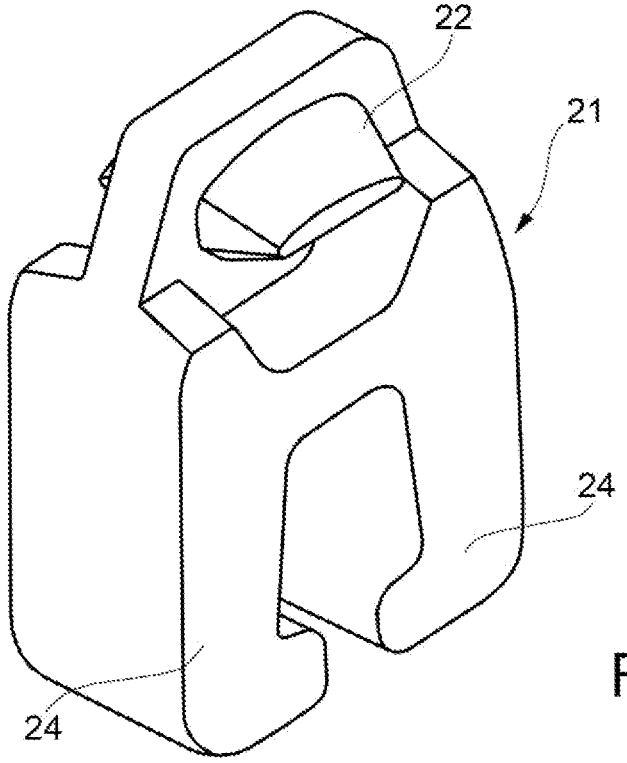
FIG. 2 is a perspective view, to an enlarged scale, of a fastener element.
Figure 4:
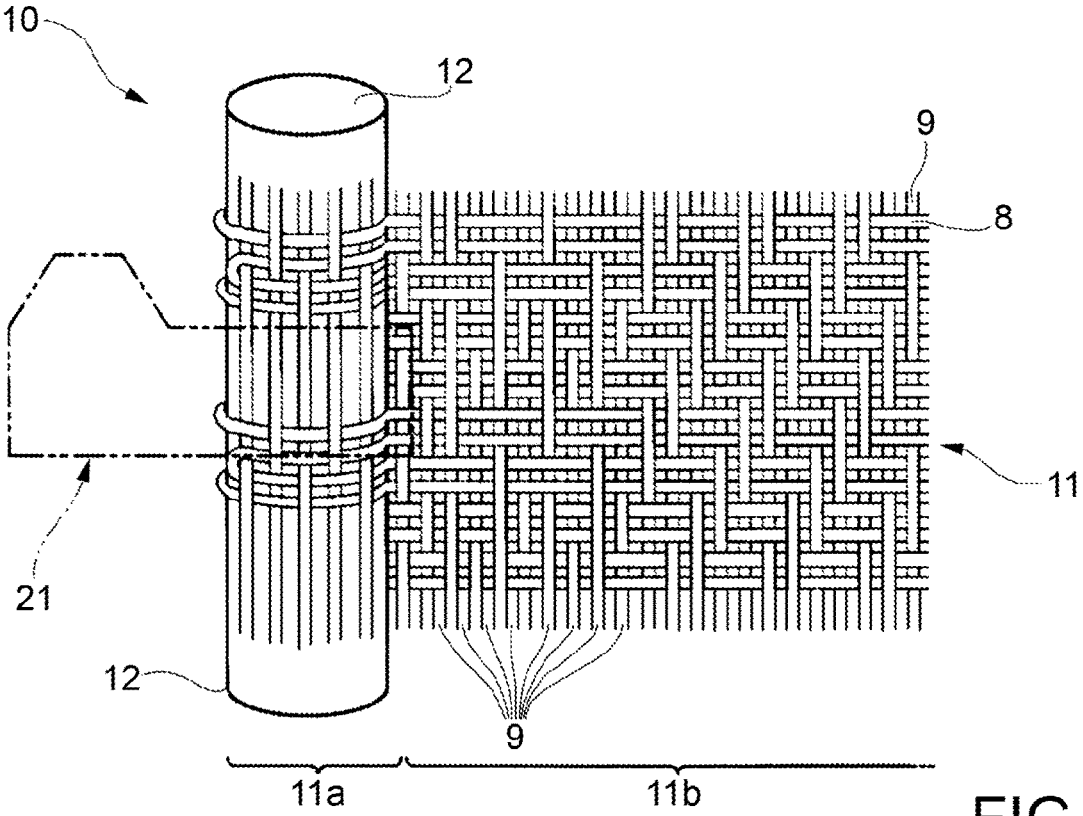
FIG. 4 is a schematic view of part of a slide fastener tape, a cord and a fastener element.

An exemplary, conventional fastener element 21 (FIG. 2) made of metal may include a coupling head 22 and a pair of leg portions 24 branched and extended from the coupling head 22. Further, a coupling convex portion is projected on a forward side surface side of the tape longitudinal direction of the coupling head 22. A coupling recess portion, into which the coupling convex portion which is existing between the coupling convex portion and leg portions, an engaging counterpart, is fitted, is recessed on a backward side surface side of the tape longitudinal direction of the coupling head 22. In this embodiment, the coupling head 22 on the frontward side surface side of the tape longitudinal direction is substantially the same shape as the coupling head 22 on the backward side surface side of the tape longitudinal direction. On the other hand, the fastener element 21 in FIG. 1 or FIG. 4 is a different type element from the element in FIG. 2, a coupling convex portion is projected on a forward side surface side of the tape longitudinal direction of the coupling head 22. A coupling recess portion, into which the coupling convex portion may enter is recessed on a backward side surface side of the tape longitudinal direction which is on the opposite side of the convex portion. Other styles of coupling heads will be known to the person skilled in the art.

The fastener element 21 is attached to the fastener tape 11 at a predetermined interval by crimping both leg portions 24 in an adjacent direction (inside) with each other and sandwiching the fastener tape and the cord in a state where the tape inner side edge portion 11*a* (also called an element attaching portion) including a cord portion is inserted between a pair of leg portions 24.

The slider 30 may be of conventional design, equipped with a slider body 31 and a pull-tab 32 that is pivotally mounted to the slider body 31. The slider body 31, not illustrated in detail, has left and right side edges 38, 39, an upper blade 33, a lower blade 34, a guide post (not shown) connecting between shoulder-side end portions (not shown) of the upper blade and the lower blade, and a pull tab attaching post 36 which is erected on the upper surface side of the upper blade.

Figure 3:
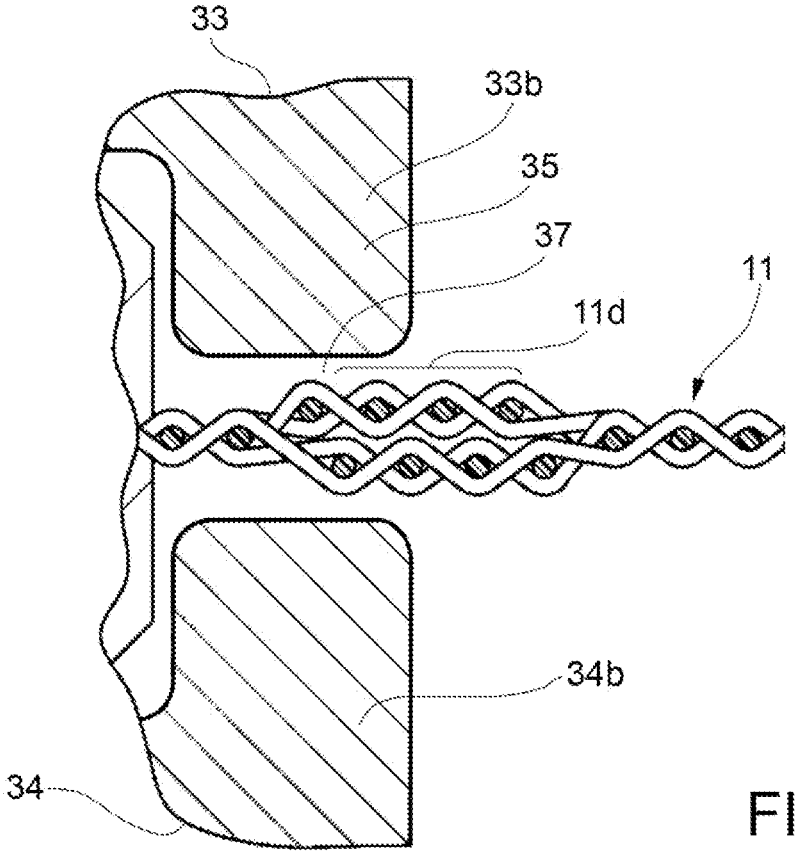
FIG. 3 is a partial cross-sectional view, to an enlarged scale, of an edge of a slide fastener tape and a slider.

The upper blade 33 (FIG. 3) is equipped with an upper blade body and right and left upper flange portions 33*b* vertically provided from right and left side edge portions of the upper blade body toward the lower blade 34. The lower blade 34 is equipped with a lower blade body and right and left lower flange portions 34*b* erected from right and left side edge portions of the lower blade body 34*a* toward the upper blade 33. Further, a tape insertion gap 37 allowing respective right and left fastener tapes 11 to be inserted therethrough is formed between the upper flange portion 33*b* of the upper blade 33 and the lower flange portion 34*b* of the lower blade 34.

The fastener tapes each have a weave structure, formed with weft yarns and warp yarns. The warp yarns of the fastener tape are arranged along the direction parallel to the sliding direction of the slider, and the weft yarns are arranged along the direction perpendicular to the sliding direction of the slider.

The warp yarns and weft yarns may be exposed on the both front and back surfaces of the fastener tape.

According to an aspect of the invention, the weft threads are made from filament yarn and the warp threads comprise a plurality of threads made from spun yarn. Embodiments may provide weft threads made only from filament yarns, while warp threads made only from spun yarn.

In the exemplary embodiment of FIG. 4, the fastener tape 11 may be woven by weft-inserting of the weft yarn 8 in an opening of warp yarns 9 using weft yarns 8 composed of folded yarns, commonly twofolded yarns (not shown) and a plurality of warp yarns 9.

The fastener tape 11, as shown in FIG. 4, has a tape main body portion 11*b* adapted to be sewn to another item such as a panel (not shown) of a coat or a jacket, or a bag, and a tape inner side edge portion (element attaching portion) 11*a* to which the fastener elements 21 are attached. The cord 12 is woven into the inner side edge portion 11*a* by the weft yarn 8 and the warp yarns 9.

According to an embodiment, the warp threads in the inner side edge portion 11*a* (FIG. 4) may comprise a plurality of spun yarns, and preferably the entirety of the warp threads comprise spun yarns.

Embodiments may provide that the warp threads in the main body portion 11*b*, extending away from the inner side edge portion 11*a*, may comprise a plurality of spun yarns. The inner side edge portion 11*a* may be made by holding and stabilizing the cord 12 within the hollow weave structure formed at the side end edge of the fastener tape 11 (FIG. 5).

Figure 5:
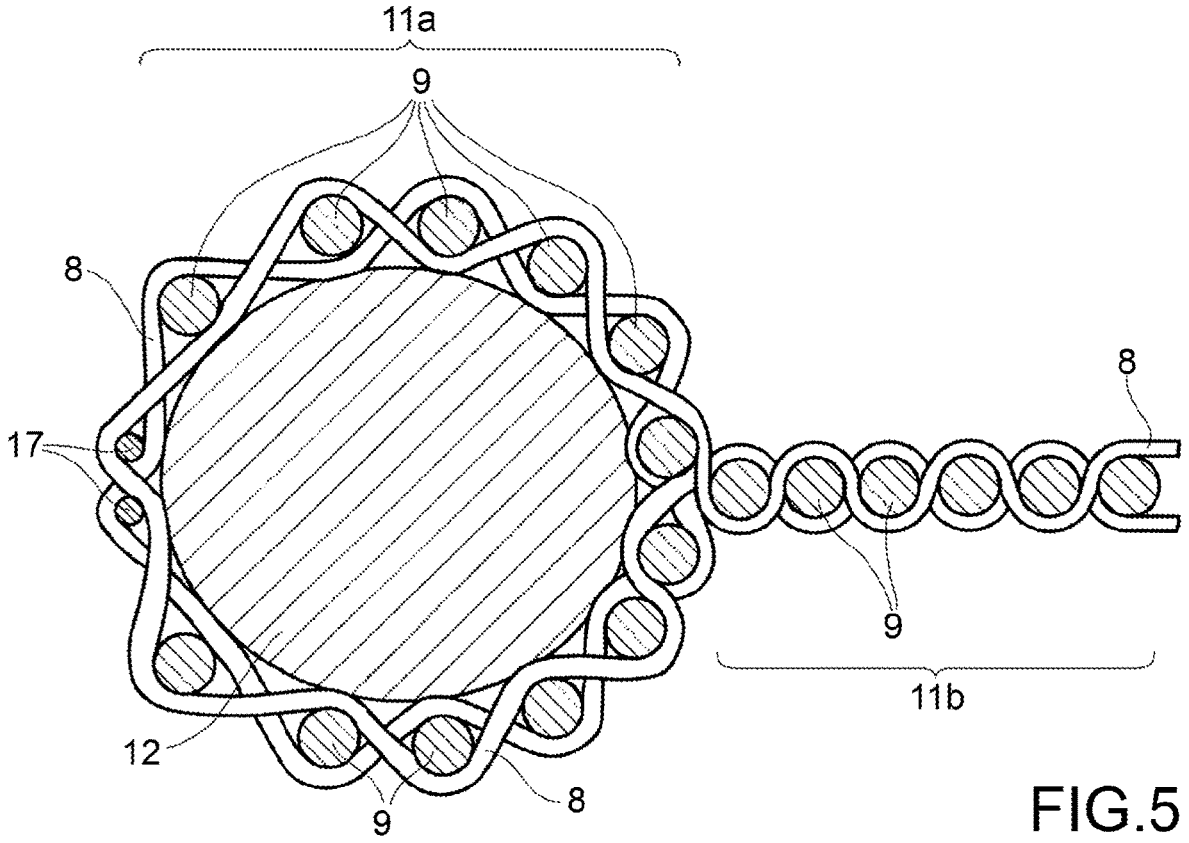
FIG. 5 is a schematic cross-sectional view of a slide fastener tape and a cord attached thereto.

As shown in the example of FIG. 5, spun yarn warp thread 9 may encompass and enclose the cord 12 even if a relatively small diameter cord 12 is used.

The protruding fibres on the surface of the spun yarn maintain the volume of the cord and ensure the attaching strength of the fastener element to the cord. Optionally fastening threads 17, which comprise an appropriate material such as nylon, may be used to fasten the cord to the tape more firmly; preferably, filament yarn may be used. Thus, one embodiment of the invention uses warp threads comprising a plurality of spun yarns in the inner side edge portion 11*a* with fastening threads 17 made from filament yarn. Fastening threads 17 are preferably provided in or near the plane of the tape and more preferably in pairs. The exemplar embodiment in FIG. 4 comprises four threads in two pairs.

A woven fastener tape in accordance with the present disclosure provides the following technical advantages. Because of the looser manner in which spun yarn is created, there is a softer, more yielding feel to the tape than when using purely harder, coarser filament yarn. However, using filament yarn for the weft maintains the strength in the tape. The combination of the strength provided by the weft filament yarns, combined with the softness of the warp spun yarns, allows a reduction of the size/diameter of the cord. A narrower and therefore more flexible cord increases the flexibility of the tape in the gap between the elements. As a result, there is a reduction in the friction generated in the movement of the slider up and down the elements, allowing the slider to run more smoothly. However, the reduction in the size of the cord also has the effect of reducing the attaching strength by which the elements are attached to the cord. The attaching strength of fastener elements can be maintained by the use of spun yarn. It is assumed that by using the less compact spun thread, the volume of the thread helps to maintain the size of the cord and thus a degree of friction to ensure the extra stability.

The attachment strength of the fastener elements is improved because the inventive use of spun yarn for the warp around the cord gives it extra volume enabling the teeth to grip to the tape.

According to an embodiment, warp threads may comprise a combination of spun yarns and filament yarns. A tape woven accordingly has proven to exhibit a lower resistance to the movement of the slider and further soften the feeling of the tape.

Further, if only spun yarn is used then there is a tendency for fibrous protrusions to rise from the yarn, which encourages fraying and possibly pilling. The use of filament weft yarn helps to secure these protrusions into the surface of the spun yarn, so helping to preserve the life of the tape.

The weaving pattern is also made more secure by the use of filament yarn in the weft. In particular, in order to construct the weave, weft thread is drawn back and forth through the warp thread and folds at the edges of the pattern. The stronger filament thread when used at the outer edge of the tape is less likely to snap and at the same time being more compact, it is able to ensure that the pattern itself is held together more tightly and securely than if spun yarn had been chosen. Equally, as the weft thread is drawn back and forth through the loom, a stronger thread is more able to handle the stresses brought on by performing this activity at a high speed. On this basis, it is preferable to use spun yarn for warp threads while all weft yarn is comprised of filament yarn. However depending on the degree of flexibility required, it may also be preferred that some warp threads compromise filament yarn thereby reducing the degree of flexibility compared to an embodiment whose weft yarns are comprised entirely of spun yarn. An example of this would be when warp yarns in the region of the cord 12 partially or completely comprise filament thread. Alternatively, that part of the tape main body 11*a* which is distal from the edge of the tape to which the cord is attached and which is generally provided to be sewn or otherwise attached to an item such as a garment or luggage makes a lesser to the contribution to the flexibility of the tape required to enable the smooth functioning of the slider. In consequence, it may be preferred to include warp yarns comprised of filament threads in this region rather than in other parts of the tape such as the main body proximal from the edge of the tape to which the cord is attached, for example to reduce the possibility of the fraying of the edge of the tape. Thus, the use of spun thread for weft yarn is most preferably utilised in the inner side edge portion 11*a* of the main body of the tape. In other regions of the tape, in consideration of the required strength of the tape, especially in relation to the attachment to the tape of the elements or the item to which the slide fastener is intended to be attached may be, the use of filament yarn in the warp threads may be considered appropriate.

According to an embodiment, the spun yarns used in this context may contain only short fibres. The spun yarns may generally be obtained by spinning together individual short fibres to make a yarn. Any short fibres can be used, not only natural fibres.

Spun yarn natural materials may include cotton, hemp, linen, bamboo, wool, cashmere, alpaca, mohair, angora, etc., material for recycled yarn include viscose rayon, acetate, cupro, lyocell, polyester.

The spun yarn may be made with two or more different types of materials.

In certain embodiments, the spun yarns may have central filament style fibres to which shorter fibres, (natural or artificial) are attached. For example, a polyester spun yarn may be used, the yarn having a polyester filament to which rayon short fibres are attached. In general, the spun yarn contains short fibres, either mixed with filament fibres or not.

The filament yarn may have one just one material.

Filament yarns may for example include recycled and/or synthetic fibres made from nylon, polyester, acrylic, vinylon, polyolefin, polyurethane, and others. These long fibres may be manufactured through a spinning process, to aid strength or obtain a specific thickness. In certain embodiments, filament yarns may include a central core of a combined filament to which spun yarn is attached. Filament yarns do not have to be limited to one material and through providing a twist in the thread, it is possible to control parameters like diameter size, strength and consistency of the cylindrical nature of the thread, elasticity, elongation, and lustre of the thread.

The material and the fineness of the warp yarns and the weft yarns composing the fastener tape 11 are not particularly limited, and may be arbitrarily changed as needed.

Embodiments may provide that the slide fastener tape is woven with a single-woven structure, and a double-woven region, woven with a double-woven structure, may be formed along a longitudinal direction of the tape intended to fit in a gap between the flanges of a side of the slider. Thus, even if the fastener tape makes contact with the flanges of the slider when the slider is slid, the entirety of the weft yarns arranged in the double-woven region is less likely to be cut and the life of the slide fastener can be extended. The double-woven region compensates for the fact that spun yarn is weaker in relation to friction as already outlined. Of course, because the weft is filament yarn, the spun yarns have an added degree of protection.

In accordance with a further embodiment, the warp in the inner side edge portion 11*a* of the tape fasteners could comprise filament yarn. Since the inner side edge portion 11*a* is close to the path of the slider and closer to teeth, it is less likely to be felt or touched by a user.

According to an embodiment (FIG. 3), the fastener tape may be woven with a single-woven structure, with a double-woven region 11*d*, woven with a double-woven structure, extending in a longitudinal direction and bridging the side edges of the slider blades. This arrangement provides extra strength in case the flanges of the slider may come in contact with the fastener tape. It will be appreciated that having a section of double weave would make that area thicker, which could theoretically result in a less smooth movement of the slider along the fastener elements. In order to avoid any such thicker area and inconvenience resulting therefrom, the warp in the double weave area may be chosen to comprise a shorter diameter than the warp of the single weave area.

Experiments Results of experiments carried out by the Applicant are reported in the accompanying graphs. The first experiment measures the diameter of the cord and the second experiment confirms the stability of the elements, thus confirming the benefit of using spun yarn in the inner side edge portion to increase the flexibility of the tape.

Figure 6:
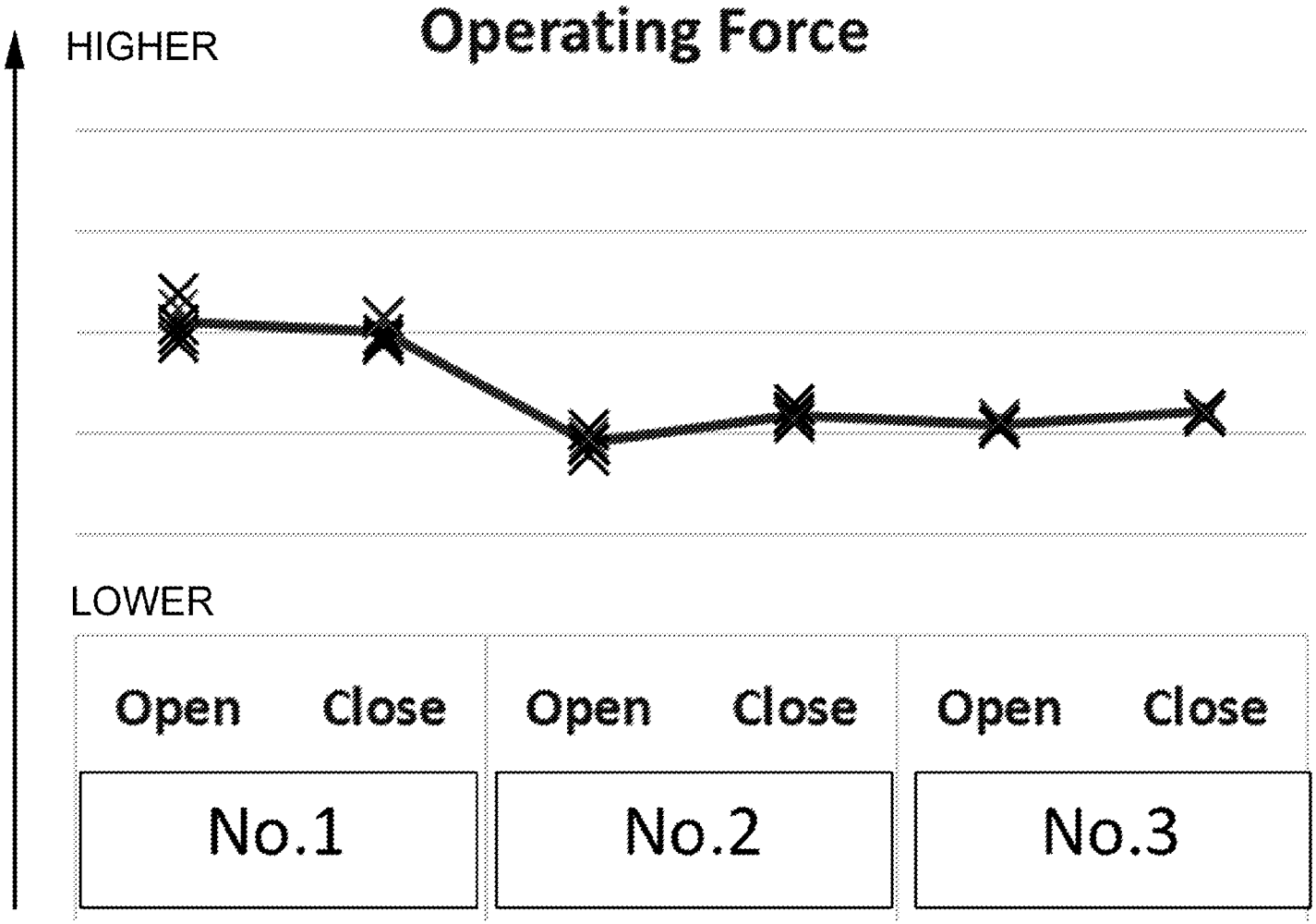
FIGS. 6 and 7 are diagrams reporting test results.

The first experiment (FIG. 6) was designed to confirm that the diameter of the cord in use in the tested embodiment has been reduced and therefore confirm that the volume of the inner side edge portion 11*a* of the tape is affected by the use of spun yarn in the inner side edge portion. That is to say, when the experiment shows that the cord has a smaller volume, the spun yarn in the inner side edge portion accounts for a greater share of the volume of the inner side edge portion, enabling a sufficient grip of teeth around the cord. For this experiment, equivalent slide fasteners with metal elements of one of the types described herein were prepared, with the cord woven into the tape, the tape and cord having the following characteristics.

No. 1—Both warp and weft were manufactured from a polyester textured yarn filament, the cord having a thickness of 1.25 mm2 according to a Pressure Measurement test described later.

No. 2—Warp was manufactured from Polyester Spun yarn and the cord thickness measured as 1.08 mm, there were no other differences.

No. 3—In this case a region of the tape was double woven as described above, otherwise this was the same as No. 2.

The slide fasteners were then tested to discover the required force to open and close (operate) the slide fastener, the results were as shown, indicating that a lower force was required in the two embodiments of the tape comprising the invention and thus there was less resistance to opening and closing.

Figure 8:
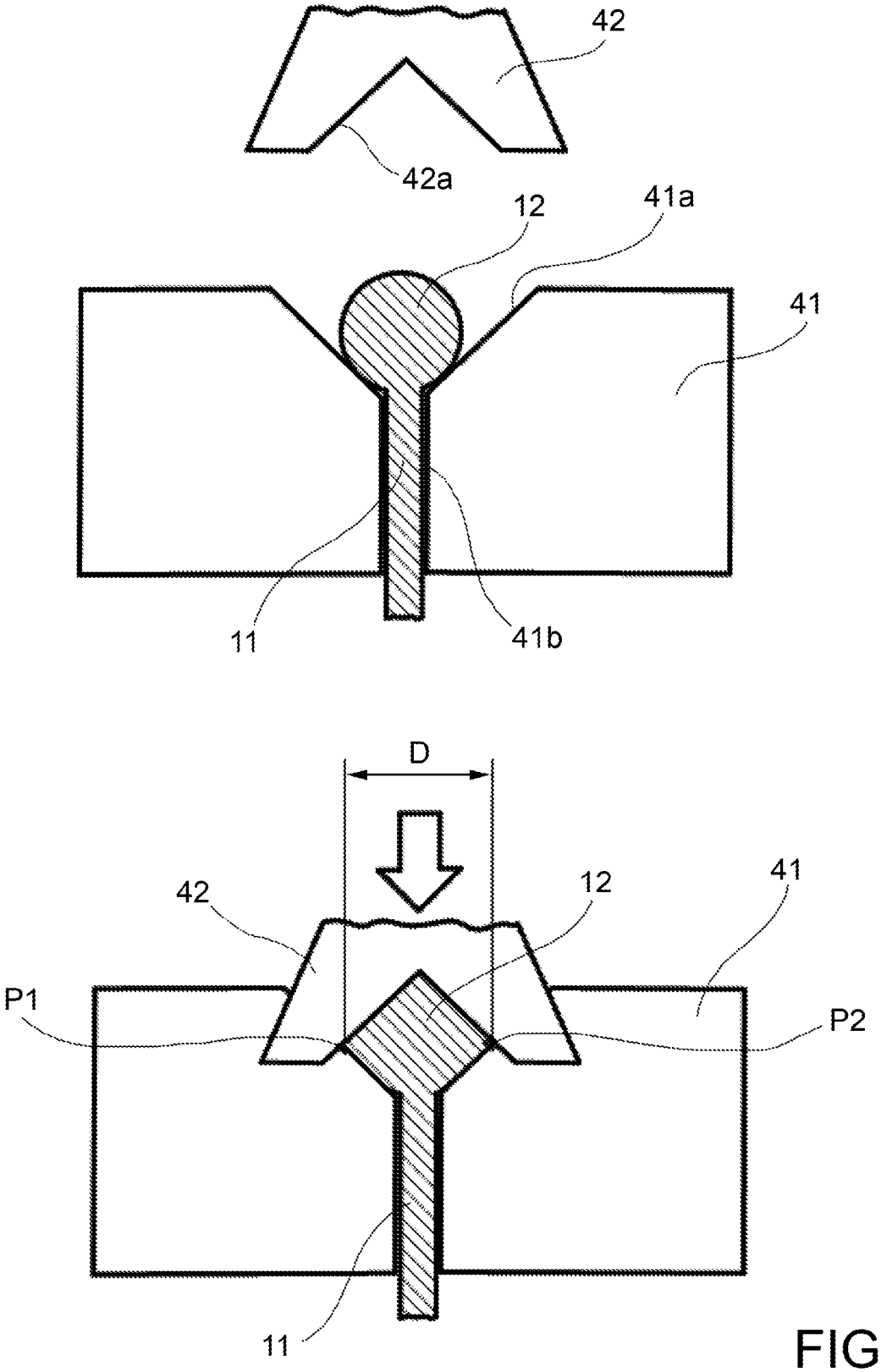
FIG. 8 is a schematic diagram showing a device used to carry out the test reported in FIG. 6.

The pressure measurement test was performed through a measuring device shown schematically in FIG. 8, pulling a tape in its width direction. The tape (without attached elements) was stretched by applying a force of 5 kgf along its length and a downward pressure of 5 kgf (49 N) is also applied to the cord in order to measure volume. The measuring device comprises a lower die 41 formed on the upper surface thereof with a substantially V-shaped cord-receiving groove 41*a* for receiving a cord 12 of a tape, and an upper die 42 provided so as to move down towards the lower die 41 and formed on the lower surface thereof with a substantially inverted V-shaped core string-pressing groove 42*a* for pressing a cord 12 which is received in the core string-receiving groove 41*a*. An angle defined by the cord-receiving groove 41*a* and cord-pressing groove 42*a* is pre-set at a right angle. In addition, the lower die 41 is formed with a tape-receiving portion 41*b* that continuously extends from the bottom of the cord-receiving groove 41*a* so as to receive the tape member 11. The measurement of the measuring device 40 is carried out by pressing a cord 12 with the upper die 42 against the lower die 41, so as to measure the compressed dimension (PM (Pressure Measurement) value) D between intersection points P1 and P2 of the core string-receiving groove 41*a* and the core string-pressing groove 42*a* when a certain amount of pressure is applied to the upper die 42.

Figure 7:
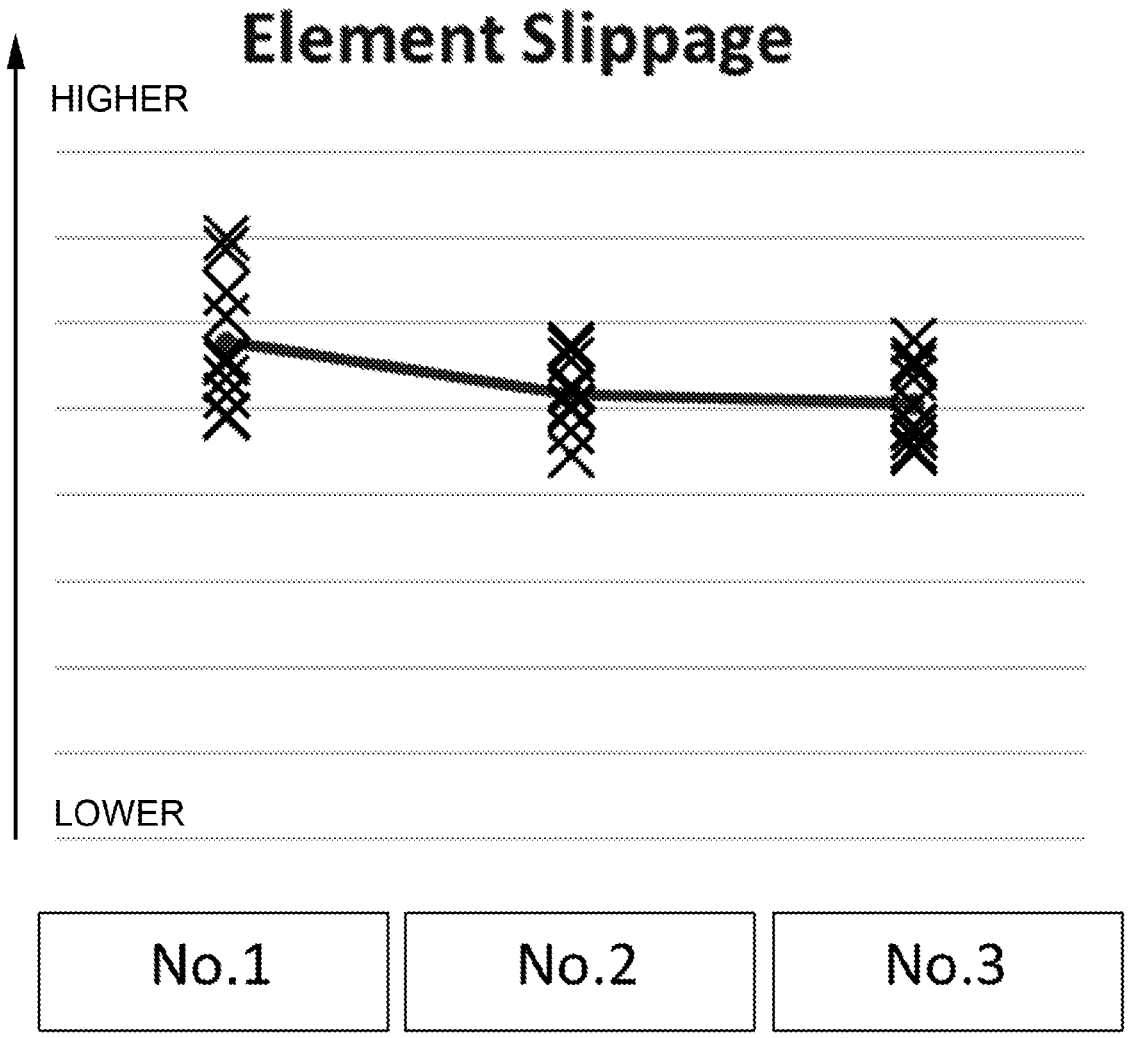

The second experiment (FIG. 7) involved embodiments of the same kind as the first experiment. A test was performed to examine how easily an element would pull away from the chain. Using the same chains as described before (without the possession of a slider), a length was cut from a stringer and the single forward element from the length was gripped in a tensile testing machine whilst the tape to which the element was attached was gripped at its backward side. Thus when the single element is pulled forward it can slide up the cord and off the end of the cord.

During this process the greatest resistance was measured. This Element Slippage test confirms the likelihood of an element moving up and down the cord when on a chain. Of course, a very low level of resistance would cause the elements to move as the slider passed over them and thus the slide fastener itself would not work very successfully.

The results show that fastener tapes No. 2 and No. 3 exhibit a loss of strength with respect to the conventional fastener tape No. 1, but the slightly lower performances still allow the slide fastener to have sufficient strength and quality to be usable.

That is to say that in the tested embodiment the improvement in the movement of the slider more than offsets any increase in the likelihood of elements moving along the cord. Any weaving pattern is available, 2/2 (so the weft goes over two warp threads and then under two warp threads) is common, but there are others, 2/1; 1/1; 3/3, etc. are other possible examples. Preferably, in order to achieve an ideal softness of the tape, a 2/2 weaving pattern should be used in at least 50% of the tape, preferably 70% more preferably 80%. Regarding the cord, a number of filament yarns may be twisted together; it is made to a knitted structure but woven into the tape.

A number of aspects and embodiments of a slide fastener and a slide fastener tape have been described.

It is to be understood that each aspect and embodiment may be combined with any other aspect or embodiment. Moreover, the invention is not restricted to the described embodiments, but may be varied within the scope of the accompanying claims and their legal equivalents. For example, as is clear from the foregoing, two kinds of warps may be used in combination as a warp, and one type of weft is used as a weft. However, in another embodiment, three or more kinds of warps may be used in combination, and two or more kinds of wefts may be used in combination, and all such forms are included in the scope of the appended claims.

What is claimed is:

1. A slide fastener tape, the fastener tape extending in a longitudinal direction and having a weave structure formed with warp threads arranged in the longitudinal direction and weft threads arranged along a transversal direction perpendicular to the longitudinal direction, the fastener tape including a cord arranged along one side edge portion of the fastener tape;

wherein:

the weft threads are made from filament yarns and the warp threads comprise a plurality of threads made from spun yarn;

the spun yarn contains only short fibres;

the fastener tape includes a main body portion;

the side edge portion is an inner side edge portion to which fastener elements are attached;

in the inner side edge portion, the cord is held and stabilized in a hollow weave structure formed at a side end edge of the fastener tape;

the warp threads in the inner side edge portion include a plurality of spun yarns;

the warp threads in the main body portion include a plurality of spun yarns; and the warp threads comprise a mixture of the spun yarns and the filament yarns.

2. The slide fastener tape according to claim 1, wherein the weft threads are made only from the filament yarns.

3. A slide fastener stringer, comprising:

the slide fastener tape according to claim 1, and a row of fastener elements arranged along the one side edge portion of the fastener tape, wherein the row of fastener elements is formed by a plurality of fastener elements which are discretely attached to the cord and the side edge portion.

4. A slide fastener, comprising:

a left fastener stringer and a right fastener stringer according to claim 3, respectively comprising a left fastener tape and a right fastener tape, each of the left fastener tape and the right fastener tape extending in the longitudinal direction and comprising the slide fastener tape, each of the fastener tapes having both the weave structure formed with the warp threads arranged in the longitudinal direction and the weft threads arranged along the transversal direction perpendicular to the longitudinal direction, each of the fastener tapes comprising the cord arranged along a respective one of two opposite edges of the fastener tapes and two rows of left and right fastener elements arranged along a respective one of the two opposite edges of the fastener tapes; and a slider for engaging and disengaging the two rows of left and right fastener elements with and from each other.

5. The slide fastener according to claim 4, wherein:

the slider has left and right side edges, and each of the left and right fastener tapes comprise a respective longitudinally extending side tape portion bridging the respective left or right side edges of blades of the slider, and wherein at least the side tape portions have weft threads made from the filament yarns and warp threads comprising a plurality of threads made from the spun yarn.

6. The slide fastener according to claim 4, wherein:

the slider has left and right side edges;

the left and right fastener tapes are woven with a single-woven structure;

each of the left and right fastener tapes comprises a respective longitudinally extending side tape portion, bridging the respective left or right side edges of blades of the slider, wherein the side tape portions are woven with a double-woven structure.

7. The slide fastener according to claim 6, wherein the warp threads in the double-woven structure have a shorter diameter than the warp threads in the single-woven structure.

8. A slide fastener comprising:

a left fastener stringer and a right fastener stringer respectively comprising:

a left fastener tape and a right fastener tape, each of the left fastener tape and the right fastener tape extending in a longitudinal direction, each of the fastener tapes having both a weave structure formed with warp threads arranged in the longitudinal direction, and weft threads arranged along a transversal direction perpendicular to the longitudinal direction, each of the fastener tapes comprising a cord and a row of fastener elements arranged along a respective side edge portion of the fastener tape, the side edge portions of the respective fastener tapes defining opposite, respective edges of the fastener tapes, wherein the weft threads are made from filament yarns and the warp threads comprise a plurality of threads made from spun yarn; and a slider for engaging and disengaging the rows of left and right fastener elements with and from each other;

wherein:

each row of fastener elements is formed by a plurality of fastener elements, which are discretely attached to the respective cord and the respective side edge portion;

the slider has left and right side edges;

the left and right fastener tapes are woven with a single-woven structure; and each of the left and right fastener tapes comprises a respective longitudinally extending side tape portion, bridging the respective left or right side edges of the slider, wherein the side tape portions are woven with a double-woven structure; and the warp threads in the double-woven structure have a shorter diameter than the warp threads in the single-woven structure.

* * * * *